US005485736A

United States Patent [19]

Collier et al.

[11] Patent Number: 5,485,736

[45] Date of Patent: Jan. 23, 1996

[54] SEAMLESS CYLINDER SHELL CONSTRUCTION

[75] Inventors: John P. Collier, Franklin Lakes, N.J.; Richard Hogle, Oceanside, Calif.; James G. Marsh, Amhurstburg, Canada; Prakash Thomas, Poway, Calif.

[73] Assignee: The BOC Group, Inc., New Providence, N.J.

[21] Appl. No.: 215,536

[22] Filed: Mar. 22, 1994

Related U.S. Application Data

[63] Continuation-in-part of Ser. No. 958,993, Oct. 9, 1992, Pat. No. 5,330,091.

[51] Int. Cl.[6] ..... B21B 45/00; B21C 23/24

[52] U.S. Cl. ..... 72/47; 72/347; 72/700

[58] Field of Search ..... 72/47, 347, 700; 205/152, 224, 227

[56] References Cited

U.S. PATENT DOCUMENTS

| | | | |
|---|---|---|---|
| 316,600 | 4/1985 | Brown . | |
| 2,026,133 | 12/1935 | Mapes | 29/148.2 |
| 2,037,732 | 4/1936 | Mudge | 29/188 |
| 2,127,712 | 8/1938 | Bart | 220/3 |
| 2,145,252 | 1/1939 | Engle et al. | 72/47 |
| 2,347,070 | 4/1944 | Austin | 220/63 |
| 2,699,596 | 1/1955 | Aronson | 29/540 |
| 2,776,475 | 1/1957 | Mapes | 29/543 |
| 3,036,696 | 5/1962 | Zimpel | 205/7 |
| 3,140,006 | 7/1964 | Nelson | 220/63 |
| 3,140,539 | 7/1964 | Holtzman | 29/497.5 |
| 3,194,643 | 7/1965 | Ma et al. | 29/191 |
| 3,281,930 | 11/1966 | Fordham | 29/470.1 |
| 3,615,902 | 10/1971 | Lesney | 72/47 |
| 3,655,349 | 4/1972 | Shah et al. | 29/196.4 |
| 3,664,890 | 5/1972 | Winter | 148/11.5 |
| 3,693,242 | 9/1972 | Chivinsky | 29/480 |
| 4,168,241 | 9/1979 | Kozima et al. | 252/18 |
| 4,364,161 | 12/1982 | Stading | 29/407 |
| 4,407,149 | 10/1983 | Smith et al. | 72/47 |
| 4,457,150 | 7/1984 | Saunder et al. | 72/349 |
| 4,485,663 | 12/1984 | Gold et al. | 72/347 |
| 4,581,107 | 4/1986 | Irie et al. | 205/227 |
| 4,599,886 | 7/1986 | Brown | 72/349 |
| 4,818,350 | 4/1989 | Batzar | 204/29 |
| 4,844,321 | 7/1989 | Matsuzawa et al. | 228/107 |
| 5,330,091 | 7/1994 | Collier et al. | 72/700 |

FOREIGN PATENT DOCUMENTS

| | | |
|---|---|---|
| 0013251 | 12/1979 | European Pat. Off. . |
| 0229954 | 12/1986 | European Pat. Off. . |
| 0438607 | 1/1990 | European Pat. Off. . |
| 55-107190 | 8/1980 | Japan . |
| 62-118986 | 11/1985 | Japan . |
| 1171163 | 7/1983 | U.S.S.R. . |
| 1364893 | 7/1971 | United Kingdom . |
| 1524675 | 8/1974 | United Kingdom . |
| 1546849 | 9/1976 | United Kingdom . |

*Primary Examiner*—David Jones
*Assistant Examiner*—Rodney Butler
*Attorney, Agent, or Firm*—David M. Rosemblum; Larry R. Cassett

[57] ABSTRACT

A method of forming a seamless cylinder shell in which a layer of nickel is electroplated on a steel sheet so that a composite sheet is formed. The composite sheet is then preferably cut into a circular blank before further processing. The circular blank is subjected to an oxalic acid pretreatment for the nickel side and a zinc phosphate pretreatment for the steel side to retain a lubricant on the two opposed surfaces thereof and is thereafter lubricated with the lubricant. The circular blank is preferably cupped, relubricated, and drawn into the seamless cylinder shell. The seamless cylinder shell can be finished into a seamless gas cylinder by spinning one end of the cylinder into a cylinder head, internally threading the formed cylinder head, and then heat treating the cylinder.

5 Claims, 1 Drawing Sheet

SEAMLESS CYLINDER SHELL CONSTRUCTION

RELATED APPLICATIONS

This is a continuation-in-part of application Ser. No. 07/958,993, filed Oct. 9, 1992, now U.S. Pat. No. 5,330,091.

BACKGROUND OF THE INVENTION

The present invention relates to a method of forming a seamless cylinder shell that is suitable for finishing into a seamless gas cylinder to store ultra-high purity gases at high pressure. More particularly, the present invention relates to such a method in which the cylinder shell is provided with an internal layer of nickel.

Gas cylinders are widely utilized in the art for storing gases at high pressure. Ultra-high purity gases used in the electronics industry present a particular storage problem in that corrosion product present on the inside of a gas cylinder can degrade the purity of the gas to be stored. This corrosion can be caused by the ultra-high purity gas itself if it is corrosive etching gas such as HCl.

Gas cylinders used in containing ultra-high purity gas are specially designed in order to maintain the purity of the gas by being fabricated entirely of nickel or by being formed with a layered construction having an outer layer composed of steel and an inner layer of nickel plated to the outer steel layer. As can be appreciated, gas cylinders formed solely of nickel are expensive and hence, layered construction is preferred from a cost standpoint. Additionally, pure nickel cylinders are not used where the intended service pressure exceeds 500 psig.

Nickel plated gas cylinders are constructed by cold drawing or billet piercing a steel blank to form a cylinder shell and then electroplating the inside of the cylinder shell. Thereafter, the cylinder shell is finished by spinning a cylinder head into the open end of the cylinder shell, threading the cylinder head, and heat treating the cylinder.

The drawback of nickel plated gas cylinders is that the nickel plating can contain cracks, voids and openings through which ultra-high purity gases can be contaminated or contaminants can be formed through a reaction of steel with the gas itself. In addition, the nickel plating produces a rough surface that is extremely susceptible to the retention of contaminants.

As will be discussed, the present invention solves the problems in the prior art that are attendant to the production of gas cylinders that are suitable for the storage of ultra-high purity gases at high pressure by fabricating the gas cylinder in accordance with a method of the present invention.

SUMMARY OF THE INVENTION

The present invention provides a method of forming a seamless cylinder shell. In accordance with the method, a layer of nickel is electroplated to a steel sheet so that the layer of nickel is uniformly bonded to the steel sheet and the composite sheet has two opposed, planar, major surface formed from, respectively, the layer of nickel and the steel sheet. The two opposed surfaces of the composite are then physically and chemically cleaned so that oil, soil, scale, oxide, and smut is removed from the composite. After the chemical cleaning, the two opposed surfaces of the composite sheet are pretreated to retain a lubricant and then, the two opposed surfaces of the composite are coated with the lubricant. After the lubrication, the composite sheet is heat treated so that plating stresses are relieved and the composite sheet is then cold drawn into the seamless cylinder shell. The seamless cylinder shell formed in such manner is closed at one end and open at the other of its ends and can then be finished into a gas cylinder by forming a cylinder head in the open end of the seamless cylinder shell by a conventional spinning operation, well known in the art. The cylinder head can thereafter be internally threaded.

It has been found by the inventors herein that cladding of the nickel and steel sheets to one another so that they are uniformly bonded throughout, such as by explosive cladding techniques or roll bonding or by plating, go towards producing a gas cylinder that is far superior to corrosion-resistant gas cylinders of the prior art. The reason for the superiority is that during the drawing process the nickel is drawn with the steel so that the inner layer of nickel has essentially no cracks, voids, holes or other imperfections. Additionally, the uniform bonding is retained after the seamless cylinder shell is drawn so that there will be no voids between the steel and nickel layers. In this regard, in a cold drawing process, metal has to flow to be drawn. The ability of metals to be drawn, before strain hardening differs with the particular metal being drawn. For instance, a cold drawing of a composite formed of stainless steel and a steel formed of a Cr—Mo alloy was attempted, but was not able to be completed, due to strain hardening of the stainless steel. Nickel also work hardens and is strain sensitive. Therefore, it was not known if nickel and steel would flow together without cracking. Hence, the fact that a nickel and steel composite can be cold drawn together is a surprising result in and of itself.

BRIEF DESCRIPTION OF THE DRAWINGS

While the specification concludes with claims particularly pointing out and distinctly claiming the subject matter that Applicants regard as their invention is believed that the invention will be better understood from the accompanying FIGURE of a seamless cylinder shell formed in accordance with the present invention.

DETAILED DESCRIPTION

Figure 1:
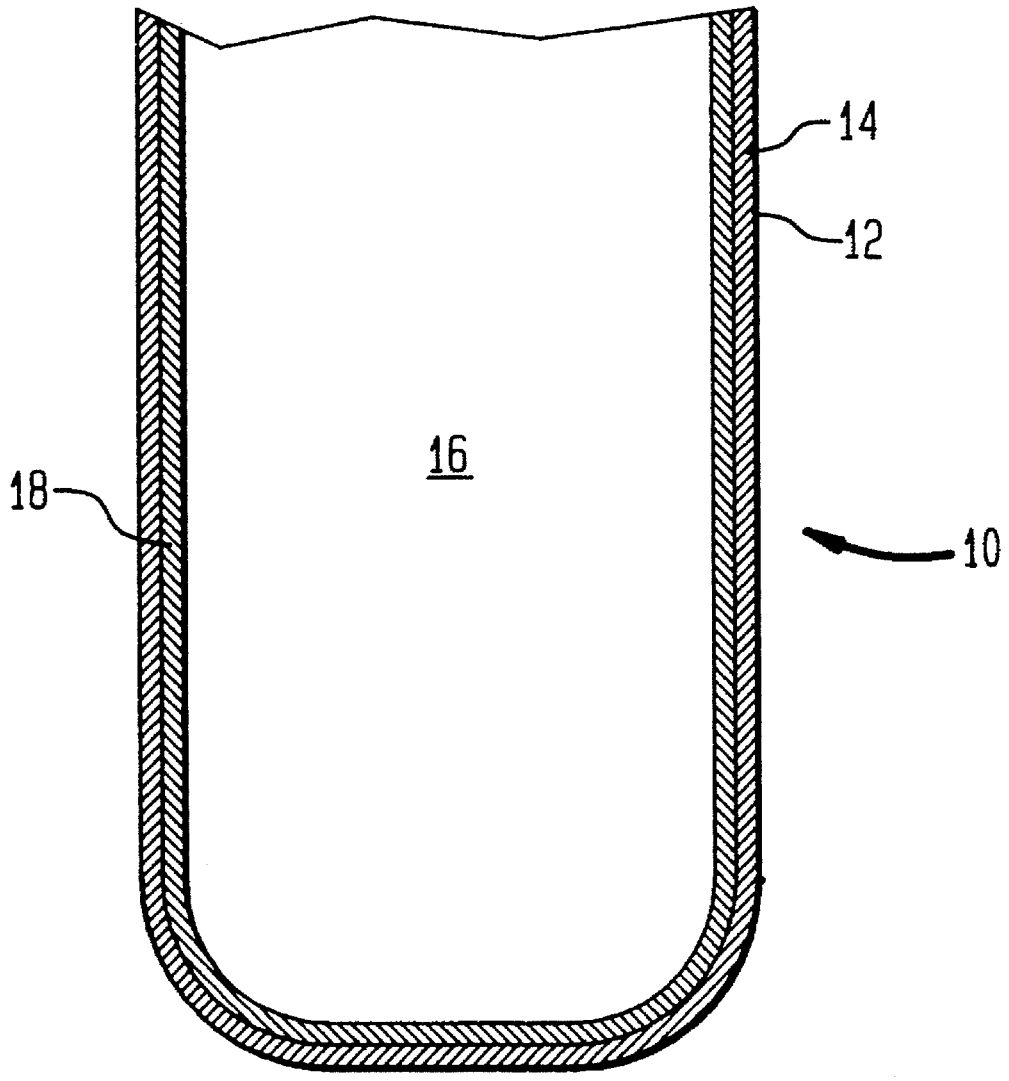

With reference to the FIGURE, a longitudinal cross-sectional view of a seamless cylinder shell 10 formed in accordance with the present invention is illustrated. Seamless cylinder shell 10 has an outer surface 12 formed by a layer of 4130 Cr—Mo steel designated by reference numeral 14, and an inner surface 16 formed by a layer of nickel, designated by reference numeral 18. It is to be noted that steels of a different alloy may also be used, for instance, C-Mn, intermediate Mn and etc.

Seamless cylinder 10 is formed by a sheet of 4130 Cr—Mo steel, approximately 9.525 min. thick and a nickel sheet, approximately 1.588 mm. thick, laid on top of the steel sheet. The nickel sheet is preferably explosively clad to the steel sheet in a conventional manner. In conventional explosive cladding, the explosive is laid on the nickel sheet. Cardboard spacers are also placed between the two sheets and a cardboard form is placed around the two sheets. After detonation of the explosive, a composite is produced having two opposed surfaces, one of which will form outer surface 12 and the other of which will form inner surface 16 of seamless cylinder shell 10. The composite thus formed has a network of microscopic interlocking wave formations at the juncture of the nickel and the steel sheets to produce a mechanical bonding that is uniform throughout the interface of the nickel and steel sheets. Another possible way to produce the uniform bonding is to roll bond the nickel and steel sheets to one another. The uniform bond produced in such manner is generally referred to in the art as a diffusion bond.

As indicated above, the present invention may be effected by electroplating a steel sheet with a layer of nickel on one major side of the sheet. The layer of nickel forms one of the two major surfaces of the composite while the opposite major surface is formed by the surface of the steel sheet not plated with the nickel. As indicated above, prior art nickel plating of steel cylinder shells produces a layer of nickel with cracks, voids and etc. The reason for this is that the electroplating is effected only after the seamless cylinder shell construction is actually formed. Since the present invention plates a steel sheet, which is essentially planar, cracks and voids are not present in the composite and thus, the clad layer is uniformly bonded to the steel sheet. It is possible, however, for some surface roughness to be produced which could either act to retain contaminants or interfere with the cold drawing process. In case of such surface roughness in the electroplated nickel layer, the nickel major surface may be smoothed by conventional machining operations.

As an example of the present invention, the electroplating will be accomplished by a Watts bath method of plating to produce a 1.143 mm. plate on an 8.92 mm. sheet of 4130 Cr—Mo steel which as would be well known to those skilled in the art would be ordered from the manufacturer as spheroidized. It has been found by the Inventor's herein that a blank formed by electroplating cannot be successfully drawn without heat treating the composite to remove plating stresses. The heat treatment comprises heating the composite in a temperature range from between about 650° C. and about 850° C. or preferably at about 650° C. for about one hour.

The composite is sized such that circles can be cut from the composite, either 38.1 cm. or 60.96 cm. in diameter, to form one or more circular blanks. As can be appreciated, the nickel and steel plates could be pre-cut to form a circular blank after cladding.

The circular blank so formed is then physically cleaned. This is accomplished by contacting the two opposed sides of the composite with an alkaline cleaner. This is accomplished by immersing the circular blank into a heated aqueous solution containing the alkaline cleaner, preferably PARCO CLEANER 2076, manufactured by Parker+ Amchem Henkel Canada LTD of 165 Rexdale Blvd, Rexdale, Toronto, Ontario M9W 1P7. The cleaner is present within the solution at a concentration in a range of between about 7% and about 8.6% by volume and the solution is heated to a temperature in a range of between about 82° C. and about 92° C. The circular blank is immersed for approximately about 3 to about 4 minutes. The treatment physically cleans the blank by removing oil and soil. Thereafter, alkaline residues are removed by immersing the circular blank into a fresh water rinse heated to a temperature in a range of between about 60° C. and about 66° C. for about 3 to about 4 minutes.

The opposed surfaces of the circular blank are then chemically cleaned through contact with an acid pickling solution to remove scale, oxide, and smut from the opposed surfaces. This is accomplished by immersing the blank into a bath comprising an aqueous solution of sulfuric acid having a concentration in a range of between about 10% and about 15% BV and a temperature in a range from between about 60° C. and about 82° C. The circular blank is then removed from the acid pickling solution after the elapse of a time period in a range of between about 6 and about 8 minutes. After removal, the circular blank is briefly immersed in a cold overflowing rinse of water at room temperature to stop the pickling action of the acid pickling solution. After the cold overflowing rinse, the circular blank is then immersed in a freshwater rinse to ensure removal of all pickling residues and to raise the temperature of the blank so that it can be coated with a lubricant. The fresh water rinse is heated to a temperature in a range of between about 71° C. and about 82° C. and the immersion is for a time period in a range of between about 6 and about 8 minutes.

After the blank has been chemically cleaned, a lubricant is applied to each of the opposed surfaces. In accordance with the present invention, this lubricant is the same for both the nickel and steel surfaces. Prior to the lubricant being applied, the surfaces of the blank are pretreated so that the lubricant will be retained on the surfaces during the cold drawing of seamless cylinder shell 10.

The pretreatment is effected immediately at the conclusion of the chemical cleaning and while the blank is still hot from the hot freshwater rinse by contacting the opposed surfaces of the blank with an oxidizing agent such as oxalic acid. It should be noted that it has been found by the inventors herein that both surfaces can be pretreated with oxalic acid even though such treatment has previously not been recommended for steel. In accordance with the present invention, the blank is immersed in an oxalic acid solution, containing preferably BONDERITE 72A manufactured by Parker+Amchem Henkel Corporation of 88100 Stephanson Highway, Madison Heights, Mich. 48872, about 6.3% to about 9.4% by volume. This solution is heated to a temperature in a range of between about 71° C. and about 77° C. and the immersion time is from about 20 to about 45 minutes. Thereafter the blank is immersed in a zinc phosphate solution contianing preferably Bonderite 181X manufactured by Parker & Amchem Henkel Corporation at about 3.7% to 4.5% by volume and titrating at 16 to 18 total acid points. this solution is heated to a temperature in a range of between, about 74 degrees C. and about 85 degrees C. and the immersion time is from about 10 to 15 minutes. Thereafter the opposed surfaces of the blank are rinsed by briefly immersing the blank in a cold overflowing rinse of room temperature water. This stops the oxalate conversion action. Any residual acidity remaining on the two opposed surfaces of the blank is then substantially eliminated by a neutralizer, preferably a bath, heated to a temperature of about 82° C. and about 93° C. and comprising PARCOLENE 21 manufactured by Parker+Amchem Henkel Canada LTD, located at the address given above, in about a 0.09% by volume aqueous solution.

The lubricant is then applied to the two opposed surfaces again by bath immersion. The bath is preferably BONDERLUBE 234, Also manufactured by Parker+Amchem Henkel Canada LTD, or any other cold forming lubricant with exceptionally high film strength, in an aqueous solution and at a concentration of about 6.25%. The bath is heated to a temperature of from about 74° C. and about 77° C. and the immersion time is in a range of between about 9 and about 12 minutes. After the conclusion of the lubricant application, the blank can then be cold drawn into a seamless cylinder shell such as seamless cylinder shell. Preferably though, the blank is first cupped, annealed, relubricated, and then drawn into the seamless cylinder shell such as illustrated by seamless cylinder shell 10.

Although the present invention has been shown and described in relation to a preferred embodiment, as will occur to those skilled in the art, numerous changes, additions and omissions may be made without departing from the spirit and scope of the invention.

We claim:

1. A method of forming a seamless cylinder shell suitable for finishing into a gas cylinder comprising:

forming a composite sheet by electroplating a layer of nickel to a steel sheet so that said layer of nickel is uniformly bonded to said steel sheet and said composite sheet has two opposed, planar, major surfaces formed from, respectively, said layer of nickel and said steel sheet;

physically and chemically cleaning the two opposed surfaces of the composite sheet so that oil, soil, scale, oxide, and smut is removed from the composite;

pretreating the two opposed surfaces of the composite sheet to retain a lubricant and then, coating the two opposed surfaces of the composite with the lubricant;

heat treating said composite so that plating stresses are relieved; and cold drawing the composite sheet into the seamless cylinder shell.

2. The method of claim 1, wherein said heat treating comprises heating the composite in a temperature range from between about 650° C. and about 850° C. for about one hour.

3. The method of claim 2, wherein said composite is heated at a temperature of about 650° C.

4. The method of claim 1, further comprising forming the composite into a circular blank directly after the cladding.

5. The method of claim 4, wherein the circular blank is cupped and relubricated prior to be cold drawn.

* * * * *